US006234277B1

(12) United States Patent
Kaczmarek

(10) Patent No.: US 6,234,277 B1
(45) Date of Patent: May 22, 2001

(54) CABLE SWAY REDUCTION DEVICE

(75) Inventor: Didier Kaczmarek, Rocky Mount, NC (US)

(73) Assignee: Draka Elevator Products, Inc., Franklin, MA (US)

( * ) Notice: Subject to any disclaimer, the term of this patent is extended or adjusted under 35 U.S.C. 154(b) by 0 days.

(21) Appl. No.: 09/307,451

(22) Filed: May 7, 1999

(51) Int. Cl.[7] ..... B66B 7/06

(52) U.S. Cl. ..... 187/414; 187/251; 174/42; 242/615.3; 248/62; 248/74.1; 254/389

(58) Field of Search ..... 403/344; 248/74.1, 248/62, 71, 313; 187/414, 251, 254, 266; 254/389, 395, 396; 242/615.3; 174/42, 135, 43, 40 CC

(56) References Cited

U.S. PATENT DOCUMENTS

| | | | | |
|---|---|---|---|---|
| H702 | * | 11/1989 | Shively et al. | 187/405 |
| D. 289,138 | * | 4/1987 | Nead | 248/62 |
| D. 304,675 | * | 11/1989 | Rogers | 248/62 |
| 1,598,385 | * | 8/1926 | Ogden | 248/62 |
| 2,347,885 | * | 5/1944 | Crickmer | 254/389 |
| 2,396,836 | * | 3/1946 | Ellinwood | 174/135 |
| 2,404,531 | * | 7/1946 | Robertson | 174/40 CC |
| 2,417,260 | * | 3/1947 | Morehouse | 174/135 |
| 2,425,935 | * | 8/1947 | Hayman | 174/135 |
| 2,695,770 | | 11/1954 | Stone | 254/389 |
| 2,956,103 | * | 10/1960 | Steel et al. | 174/40 R |
| 3,246,073 | * | 4/1966 | Bouche et al. | 174/42 |
| 3,295,832 | * | 1/1967 | Fowler | 254/389 |
| 3,662,862 | | 5/1972 | Poller | 187/407 |
| 3,826,339 | * | 7/1974 | Brokaw | 174/42 |
| 3,967,050 | * | 6/1976 | Makihara et al. | 174/135 |
| 3,991,856 | * | 11/1976 | Shigeta et al. | 187/266 |
| 4,079,816 | * | 3/1978 | Ohta | 174/42 |
| 4,106,156 | * | 8/1978 | Fisher et al. | 254/389 |
| 4,117,908 | * | 10/1978 | Nara et al. | 187/254 |
| 4,611,868 | * | 9/1986 | Matsui et al. | 174/135 |
| 4,619,545 | * | 10/1986 | Kuttenbaum | 403/344 |
| 4,664,229 | * | 5/1987 | Obst | 187/411 |
| 4,716,989 | * | 1/1988 | Coleman et al. | 187/414 |
| 4,719,321 | * | 1/1988 | Kozel et al. | 174/135 |
| 4,724,929 | * | 2/1988 | Coleman et al. | 187/414 |
| 4,777,327 | * | 10/1988 | Richardson, Jr. | 174/42 |
| 5,025,893 | * | 6/1991 | Saito | 187/266 |
| 5,103,937 | * | 4/1992 | Robertson | 187/414 |
| 5,300,737 | * | 4/1994 | Nakanishi | 187/251 |

(List continued on next page.)

FOREIGN PATENT DOCUMENTS

| | | | | |
|---|---|---|---|---|
| 722083 | * | 1/1955 | (GB) | 248/74 |

OTHER PUBLICATIONS

Whisper–Flex® Product Literature; Whisper–Flex® Dampening Device for installations traveling over 350 ft/min, 178m/sec, 1985.

Whisper–Flex® Product Literature; Whisper–Flex® Compensating Cable, 1988.

Whisper–Flex® Product Literature; Whisper–Flex® Elevator Compensating Cable Installation Procedures, 1985.

Whisper–Flex® Product Literature; Elevator Cable Cone, 1992.

*Primary Examiner*—Robert P. Olszewski
*Assistant Examiner*—Paul T. Chin
(74) *Attorney, Agent, or Firm*—Alston & Bird LLP

(57) ABSTRACT

A sway reduction device having a cable receiving section, the cable receiving section being formed of a shock-absorbing material and comprising a flexure portion and an aperture for receiving a cable therethrough. The sway reduction device also includes a mounting section with subsections and at least one mounting member for mounting the sway reduction device to a surface. The subsections are moveable generally toward and away from each other whereby the flexure portion is flexed when the subsections are moved away from each other for installing the sway reduction device around a cable.

42 Claims, 5 Drawing Sheets

U.S. PATENT DOCUMENTS 5,301,907 * 4/1994 Julian ..... 174/135
5,443,232 * 8/1995 Kesinger et al. ..... 248/62
5,556,679 * 9/1996 Booles ..... 428/184
5,573,290 * 11/1996 Smith ..... 403/344
5,662,628 * 9/1997 Hollands ..... 604/342
5,736,677 * 4/1998 Sato et al. ..... 174/135
5,878,847 * 3/1999 Mustalahti et al. ..... 187/406
5,941,653 * 8/1999 Cipriani ..... 403/344

* cited by examiner

CABLE SWAY REDUCTION DEVICE

FIELD OF THE INVENTION

The present invention relates to a sway reduction device for use with a cable, and more particularly, for use with an elevator compensating cable.

BACKGROUND OF THE INVENTION

Elevator hoistways typically include at least one elevator cable that supports and moves an elevator car and counterweight during operation of the car. The elevator compensating cable can be installed through a sway reduction device designed to dampen oscillations or cable swaying motion as the car and counterweight are moved.

An example of a known dampening device is the Whisper-Flex® Dampening Device (WFDD) made commercially available by Republic Wire & Cable of Rocky Mount, N.C., USA. The WFDD includes a series of wear resistant and flame retardant rollers that are disposed on four sides of the cable. The rollers are rotatably mounted to a metal frame by sealed bearings and brackets. A typical WFDD assembly can consume over 200 cubic inches of space. During installation, four mounting holes each receive a respective mounting bolt for mounting the assembly to a stationary surface, for example, an elevator rail or support beam in an elevator hoistway.

The WFDD successfully performs the sway dampening function but it may have some disadvantages, for example, manufacturing the device can be expensive and installation can be difficult. More particularly, assembly of the WFDD can be a time consuming procedure. In addition, the size and weight of the WFDD assembly can make installation difficult in a crowded elevator hoistway.

OBJECTS OF THE INVENTION

It is an object of the present invention to provide a sway reduction device for receiving a cable, comprising a cable receiving section, the cable receiving section comprising a wall defining an aperture for receiving a cable therethrough; and a mounting section, the mounting section being formed of a flexible, shock absorbing substance and comprising mounting members for mounting the sway reduction device to a surface, when the cable impacts the wall, the mounting section is operative to at least partially absorb the shock of the impact.

It is an object of the present invention to provide a sway reduction device comprising a cable receiving section, the cable receiving section being formed of a shock-absorbing material and comprising a flexure portion and an aperture for receiving a cable therethrough; and a mounting section, the mounting section comprising subsections and at least one mounting member for mounting the sway reduction device to a surface; the subsections being moveable generally toward and away from each other whereby the flexure portion is flexed when the subsections are moved away from each other for installing the sway reduction device around a cable.

It is an object of the present invention to provide an elevator system comprising an elevator car, an elevator compensating cable attached to a support bracket, and a safety support, the elevator compensating cable passing through at least one sway reduction device and is attached to a counterweight and the elevator car, the elevator cable comprising a substantial mass of material, when the elevator cable is moved during operation of the elevator system the cable impacting a wall of the sway reduction device, the sway reduction device comprising a shock absorbent mounting section that is flexible and operative to dampen the impact, at least partially absorbing and dissipating the energy transmitted from impact with the cable.

BRIEF DESCRIPTION OF THE DRAWING FIGURES

DETAILED DESCRIPTION OF THE INVENTION

Figure 1:
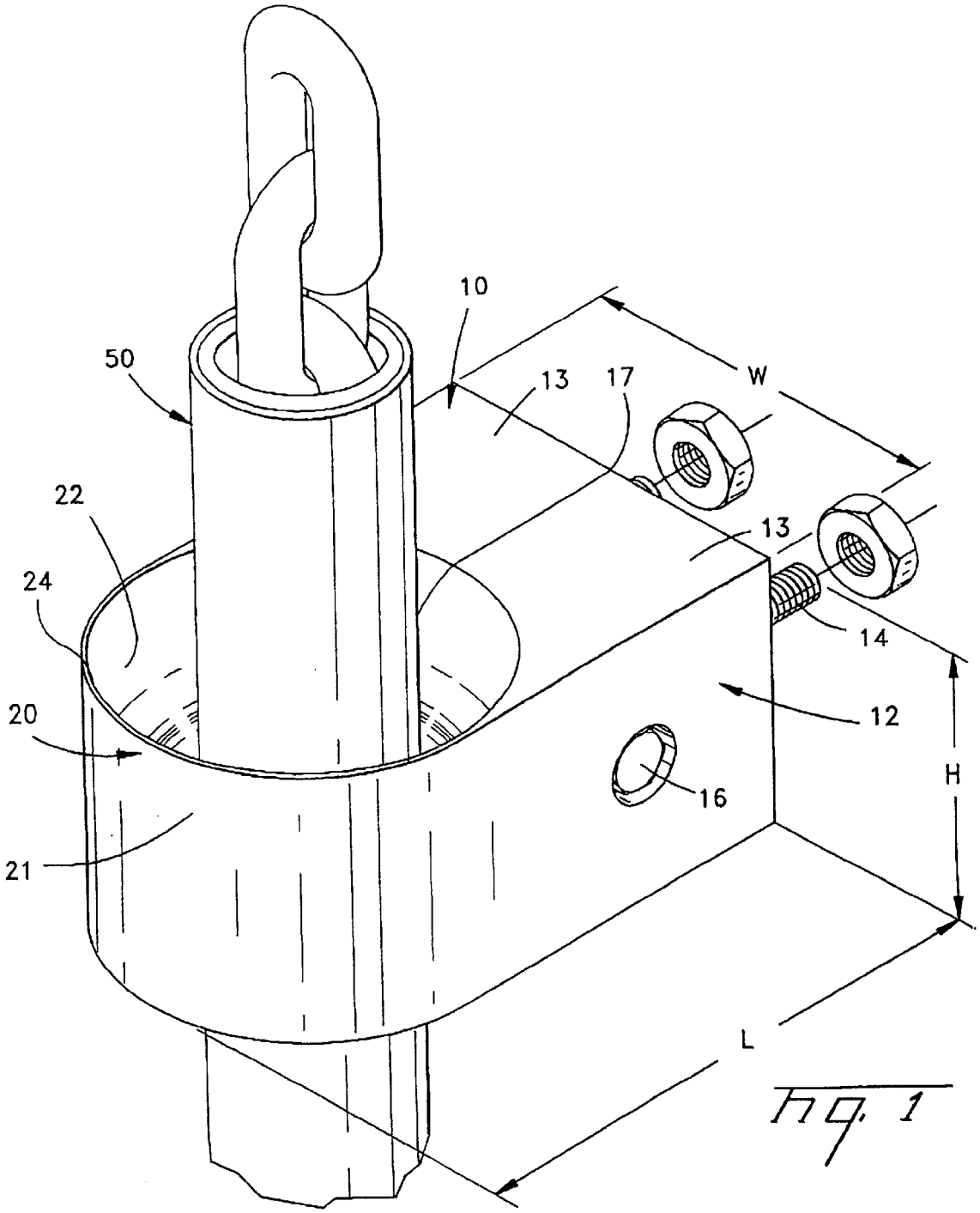
FIG. 1 is an isometric view of a sway reduction device according to the present invention with a compensating cable passing through it.
Figure 2:
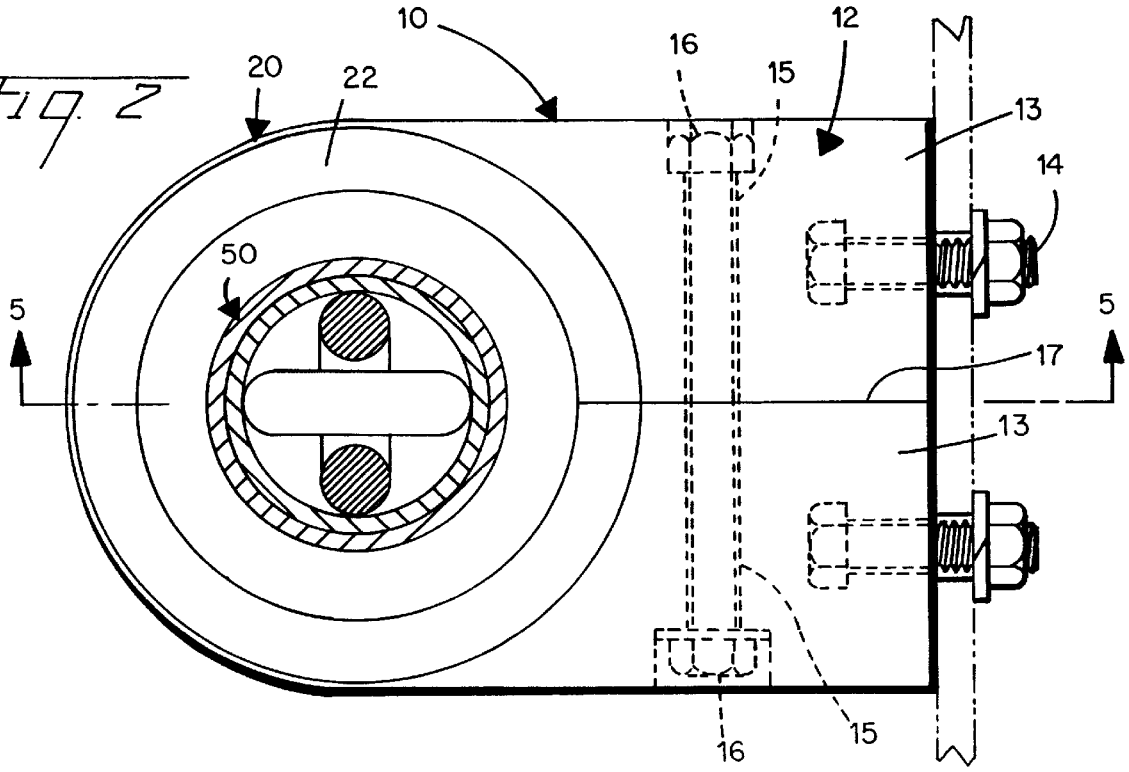
FIG. 2 is top view of the sway reduction device of FIG. 1.

With reference to FIGS. 1–5, embodiments of a sway reduction device 10 according to the present invention will be described. Sway reduction device 10 comprises a mounting section 12 and a cable passage section 20. Mounting section 12 comprises at least two subsections 13 divided by a slit 17. Each subsection 13 can include at least one mounting member, for example, mounting bolts 14 as shown for example in FIG. 2. Subsections 13 can be connected by a connecting member, for example, a hex-head connecting bolt 16. Connecting bolt 16 can be inserted into respective bores 15 formed in subsections 13, e.g., as shown in FIG. 2. At least one of bores 15 can be formed with a hex-shaped countersunk hole for receiving the hex head of connecting bolt 16. Slit 17 can be a generally planar interface between facing sides of subsections 13 that generally bisects mounting section 12. Slit 17 can be generally medially disposed between edges of sway reduction device 10, or it may be offset to one side (not shown). In addition, slit 17 may have a generally flat shape between subsections 13, or it may comprise arcuate shapes or a combination of flat and arcuate shapes (not shown).

Figure 4:
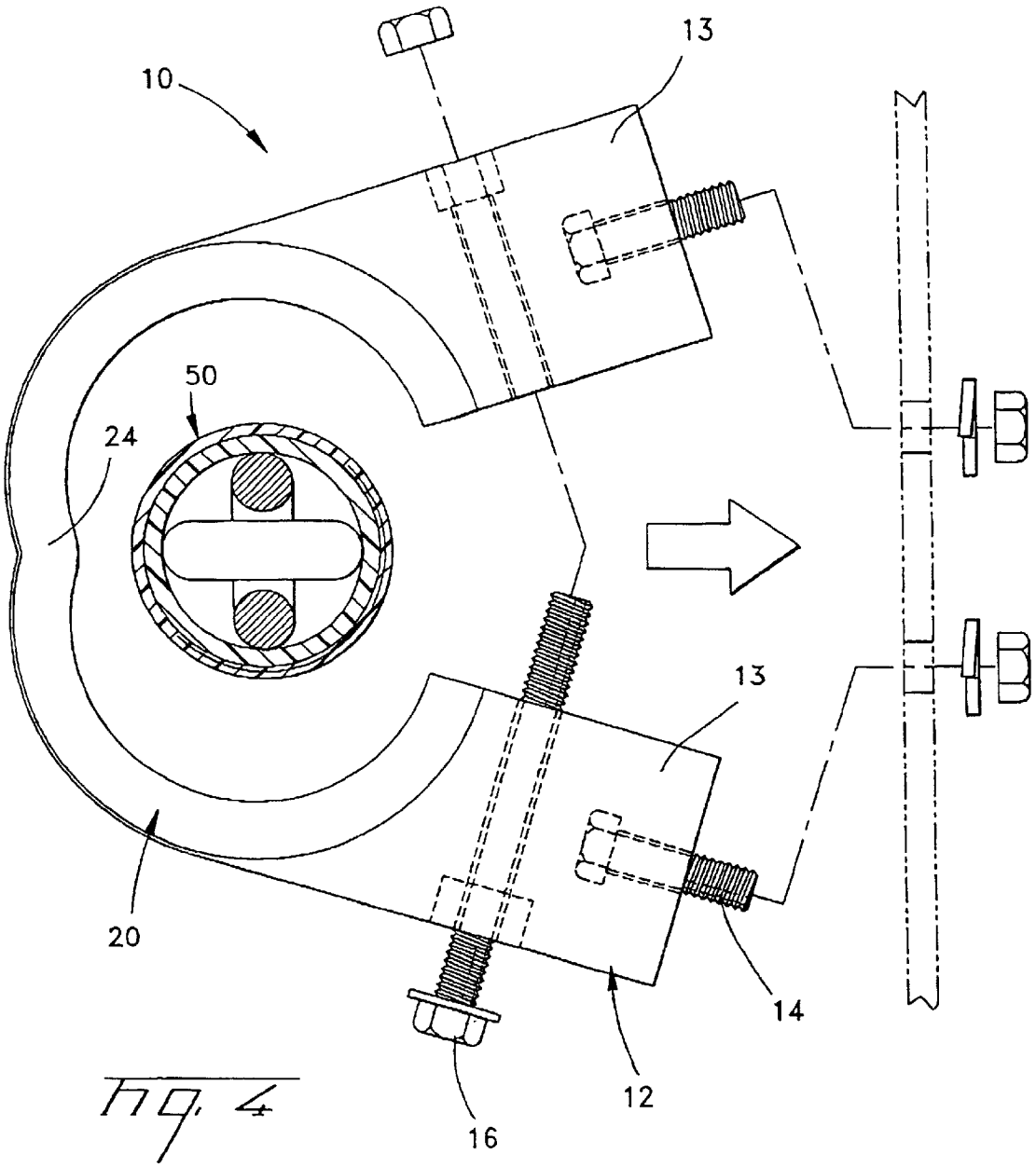
FIG. 4 is a side view of the sway reduction device of the present invention in a flexed state for accommodating installation thereof with an existing cable.
Figure 5:
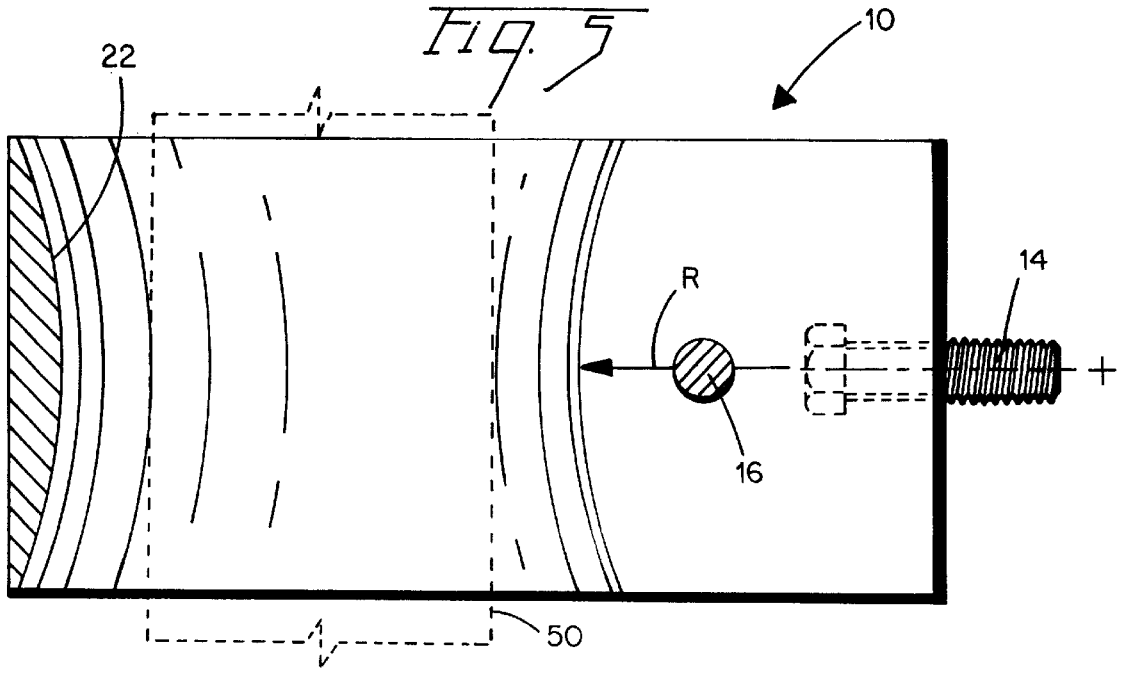
FIG. 5 is a cross sectional view of the sway reduction device of FIG. 2 taken at line 5—5.
Figure 6:
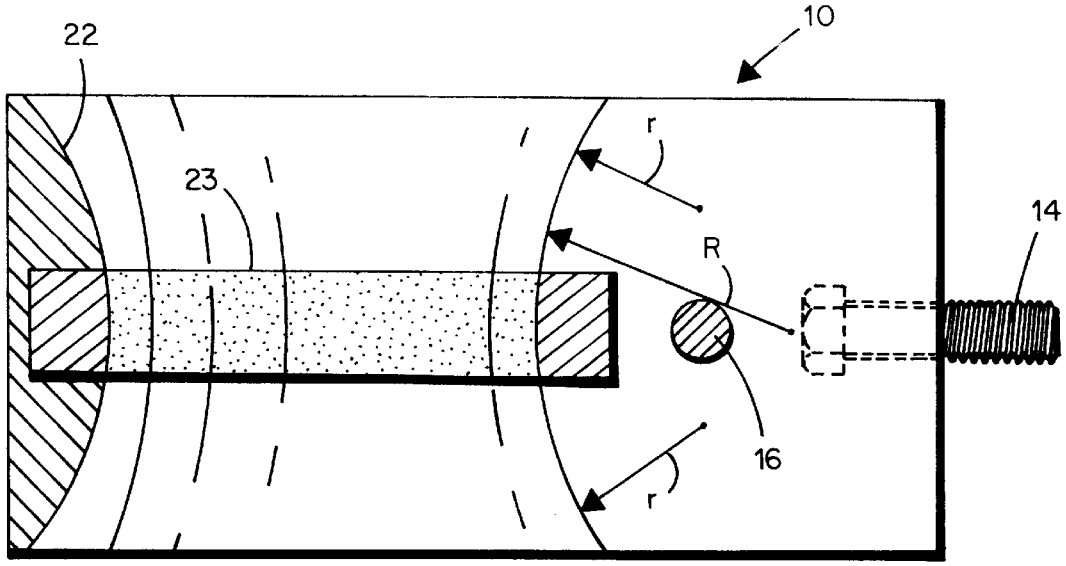
FIG. 6 is a cross sectional view of an alternative embodiment of the sway reduction device of the present invention.

Cable passage section 20 comprises an outer surface, for example, a semi-cylindrical outer surface 21. Cable passage section 20 also includes a flexure portion 24 (FIG. 1) for flexing when subsections 13 are moved away from each other (FIG. 4). Cable passage section 20 includes a cable passage through which a cable can pass, for example, an elevator compensating cable 50 (FIG. 1). The aperture is defined by a through-extending, generally annular and smooth wall 22. Wall 22 may include a profile with arcuate portions that can be defined by a constant or varying radius of curvature. For example, wall 22 may comprise an hourglass like profile as viewed in a cross section (FIGS. 5–6). The profile may comprise a constant radius of curvature R, and/or generally parabolic arcs having a varying radius of curvature. Alternatively, wall 22 may be generally cylindrical, or it may be a combination of generally cylindrical and arcuate portions.

Figure 3:
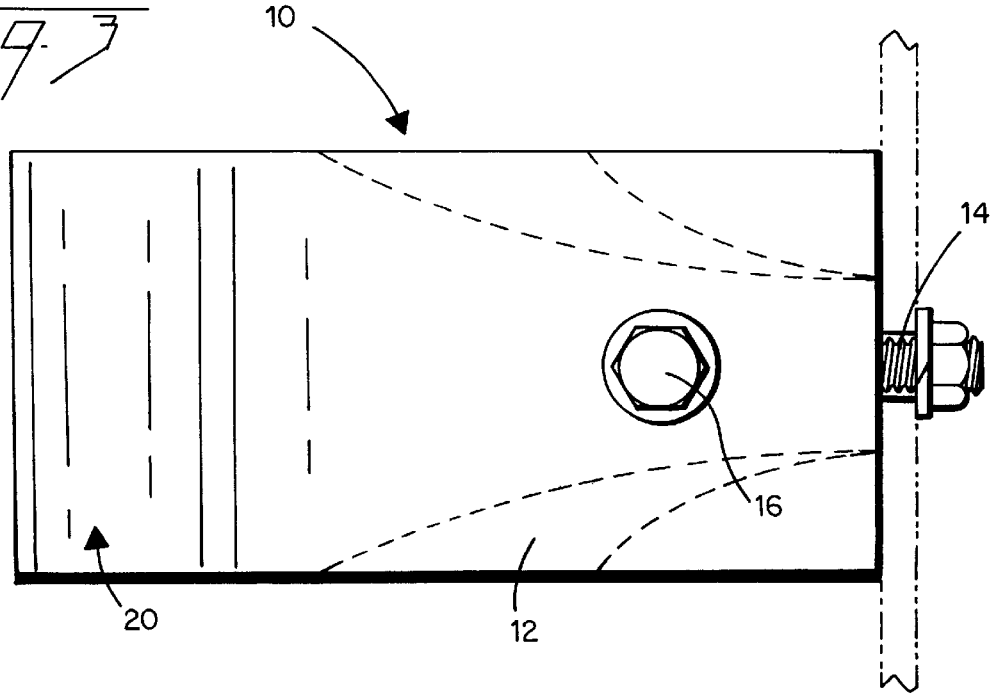
FIG. 3 is side view of the sway reduction device of FIG. 1.

Sway reduction device 10 presents a compact design. For example, the length L, width W, and height H of device 10 (FIG. 1) can be about 6, 4, and 3 inches, respectively. In other words, sway reduction device 10 can consume a volume of roughly about 72 cubic inches of space in an elevator hoistway. In addition, the present invention includes embodiments that minimize the volume of material required to manufacture device 10. For example, the corners of sections 12,20 can be tapered to reduce the volume of potentially costly thermoplastic material (FIG. 3).

Sway reduction device 10 can include a friction guard 23 (FIG. 6) formed of, for example, any suitable non-metallic material. Friction guard 23 is preferably a split ring that is removably attached to a recess formed in wall 22 so that if it becomes worn it can be easily replaced. Friction guard 23 can comprise a low-friction substance, for example, NYLON, TEFLON, a silicone additive, or a highly polished resilient metallic material, e.g., brass. Friction guard 23 can also be a composite of a non-metallic and metallic materials, for example, a metal ring coated with a suitable thermoplastic. Moreover, friction guard 23 can be a foamed substance, e.g., foamed polyurethane.

Manufacture of sway reduction device 10 can be accomplished in a molding process, for example, in a casting or injection molding process. Mounting section 12 and cable passage section 20 are preferably monolithically formed. A suitable thermoplastic rubber material with suitable mechanical properties can be used, for example, polyurethane with a Shore D hardness of 50–65. The mold can be an aluminum mold with a smooth finish. The mold should support mounting bolts 16, and can include parts that will define, for example, wall 22, slit 17, and bores 15. Sway reduction device 10 can be formed of any suitable moldable material that exhibits low friction, wear and impact resistance, and suitable flexibility and shock absorbing properties. For example, sway reduction device 10 can include a thermoplastic rubber other than polyurethane, a thermoset, or other suitable moldable material. Alternatively, the moldable material may comprise a thermoplastic elastomer, e.g., a block copolymer such as KRATON. The moldable material may include a flame retardant additive, and/or an inert filler, for example, fumed silica, glass beads, and/or microspheres. Additionally, the moldable material can be foamed mechanically and/or foamed with a chemical foaming agent. The moldable material may also include a noncompatible additive, for example silicone, that can migrate to the surface of wall 22 for reducing friction between sway reduction device 10 and the jacket of an elevator compensating cable. Moreover, the mold can be modified to reduce the amount of moldable material required, for example, outer surfaces can be tapered from cable passage section 20 toward mounting bolts 14 (FIG. 3).

Figure 7:
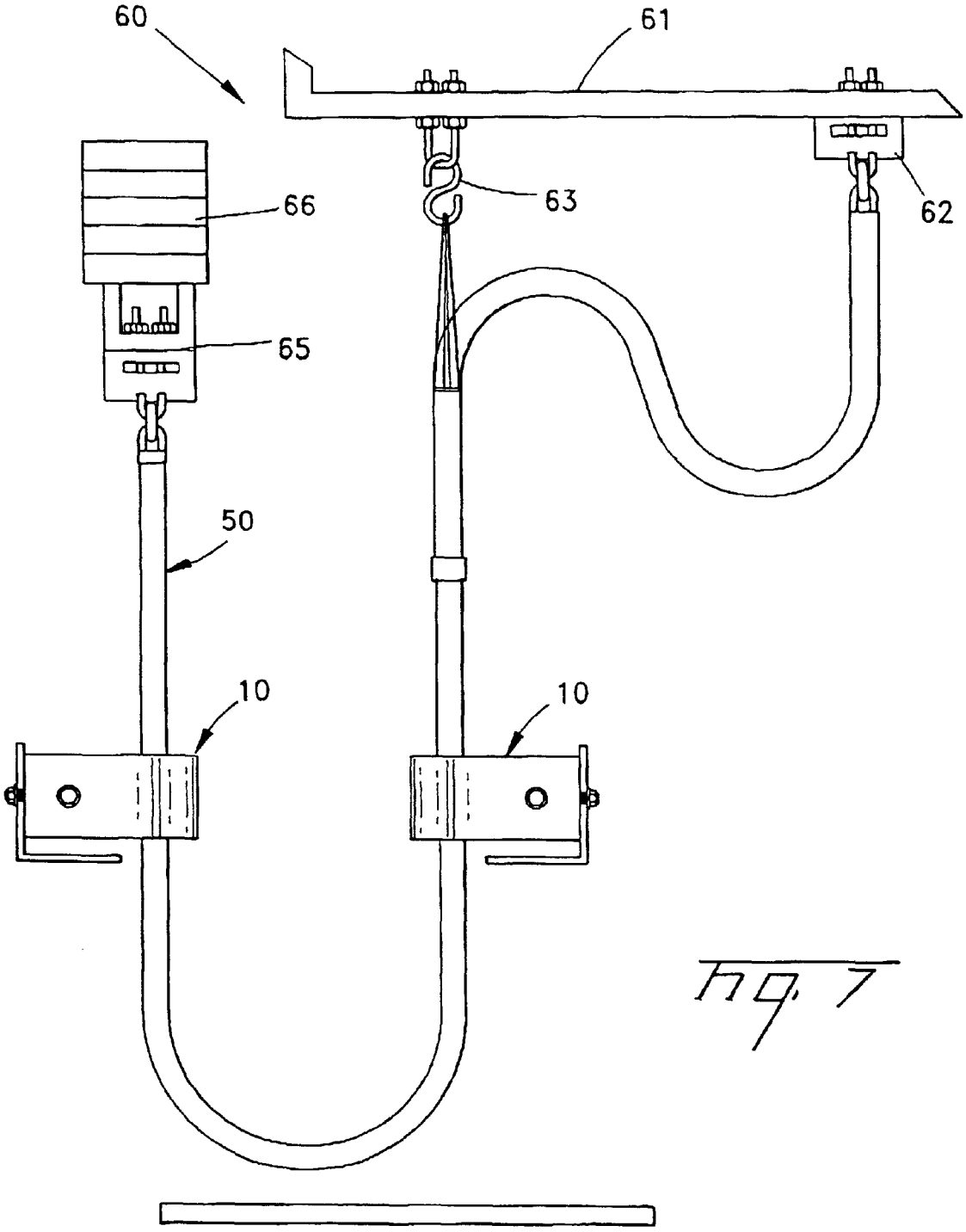
FIG. 7 is a schematic view of an elevator system including sway reduction devices according to the present invention.

Sway reduction device 10 can be installed in an exemplary elevator system 60 shown schematically in FIG. 7. Elevator system 60 includes an elevator car 61, and an elevator compensating cable 50 attached to a support bracket 62 and a safety support 63. Compensating cable 50 passes through two sway reduction devices 10 and is attached to a counterweight support bracket 65 and a counterweight 66. In an exemplary installation procedure, sway reduction device 10 can be installed about an existing cable 50 by separating subsections 13 and flexing flexure portion 24 so that slit 17 is opened wide enough to permit cable 50 to be received in cable receiving section 20 (FIG. 4). Slit 17 is then closed, mounting bolts 14 are fastened to a surface, and connecting bolt 16 is fastened so that subsections 13 are held firmly together. At this point, sway reduction device is firmly mounted and is ready to be impacted by the mass of cable 50. A typical elevator compensating cable 50 is a substantial mass—it can include a heavy metal chain embedded in a thermoplastic, metal filler beads, and a durable outer jacket of thermoplastic. When cable 50 is moved during normal operation of system 60, this mass of cable may sway and may repeatedly impact walls 22 of sway reduction devices 10.

Sway reduction device 10 acts as a cushion in that it at least partially absorbs and dissipates the energy transmitted from impact with the heavy mass of cable 50. This cushioning occurs because at least one of sections 12,20, but preferably both sections, is formed of a flexible, shock absorbent and moldable material that can function as a flexible spring and a shock absorber. This can be analogous to a typical spring, mass, damper system for at least partially dissipating energy generated by a force acting on the mass. Mounting section 12 and/or cable receiving section 12 can function as a spring, due to flexibility of the moldable material, and as a damper, due to the inherent ability of the moldable material to cushion/dissipate impact forces.

The present invention has thus been described with reference to the exemplary embodiments, which embodiments are intended to be illustrative of the present inventive concepts rather than limiting. Persons of ordinary skill in the art will appreciate that variations and modifications of the foregoing embodiments may be made without departing from the scope of the appended claims. For example, the mounting and connecting members can comprise, latching structures including linearly and/or rotatably acting cam locking surfaces and/or latch arms. Mounting members may also comprise such mounting components as, for example, U-bolts, plates, brackets, angle iron, and/or stamped metal parts. The aperture defined by wall 22 can be a non-annular shape, for example, oval, elliptical, rectangular, square, etc. If an oval slope shape is used, a two-piece friction guard can be used with respective pieces located at ends of the oval with one piece having a function of fastening subsections 13 together thereby obviating the need for connecting member 16. Furthermore, the cable receiving section may include movable, e.g. rotatable, parts for engaging the cable.

What is claimed is:

1. An elevator system comprising:

an elevator car;

a counterweight;

an elevator compensating cable operably engaged between the elevator car and the counterweight, the elevator compensating cable being adapted to be at least partially disposed in spaced and substantially parallel relation to a wall disposed adjacent to the elevator car; and a sway reduction device operably engaging the wall and for receiving the elevator compensating cable therethrough, the sway reduction device comprising:

a cable-receiving structure having opposed engagable distal portions and a flexible medial portion with at least the distal portions being comprised of a flexible shock-absorbing substance so as to be capable of at least partially dissipating an impact energy resulting from contact of the elevator compensating cable with the cable-receiving stricture, the medial portion being configured to define an aperture upon engagement of the distal portions such that the aperture defines an axis, the cable-receiving structure being configured to receive the elevator compensating cable within the aperture through the distal portions and such that the elevator compensating cable is capable of passing freely through the aperture in the axial direction, the distal portions being configured to correspondingly engage so as to extend transversely in substantially perpendicular relation to the aperture axis; and a mounting member extending from each distal portion so as to be disposed perpendicularly to the aperture axis, the mounting members being configured to extend in substantially the same direction upon engagement of the distal portions and being adapted to engage the wall so as to secure the cable-receiving structure thereto.

2. An elevator system according to claim 1 wherein the cable-receiving structure is comprised of a moldable material.

3. An elevator system according to claim 2 wherein the moldable material further comprises at least one of a flame retardant additive and an inert filler.

4. An elevator system according to claim 2 wherein the moldable material is configured to be at least partially foamed.

5. An elevator system according to claim 2 wherein the moldable material comprises a non-compatible additive configured to migrate toward a surface of the cable-receiving structure.

6. An elevator system according to claim 1 further comprising a friction guard configured to operably engage and extend along the medial portion of the cable-receiving structure and to extend inwardly from the medial portion toward the aperture axis.

7. An elevator system according to claim 6 wherein the friction guard further comprises a medial guard portion and opposed engagable ends, the medial guard portion being configured to define a guard aperture upon engagement of the ends, the guard aperture being coaxial with the aperture axis, the friction guard being configured to receive the elevator compensating cable within the guard aperture through the ends and such that the elevator compensating cable is capable of passing freely through the guard aperture in the axial direction.

8. An elevator system according to claim 6 wherein the friction guard is configured to removably engage the cable-receiving structure.

9. An elevator system according to claim 6 wherein the friction guard comprises at least one of a metallic portion and a non-metallic portion.

10. An elevator system according to claim 6 wherein the friction guard is comprised of a material configured to be at least partially foamed.

11. An elevator system according to claim 6 wherein the friction guard comprises a low friction material.

12. An elevator system according to claim 6 wherein the friction guard comprises at least one of nylon, tetrafluoroethylene, silicone, and a polished metal.

13. An elevator system according to claim 1 wherein the medial portion of the cable-receiving structure defining the aperture is further configured to extend in the axial direction so as to define a bore having opposed axial ends and a midpoint.

14. An elevator system according to claim 13 wherein the midpoint of the bore has the same diameter as the opposed axial ends such that the bore comprises a cylinder.

15. An elevator system according to claim 13 wherein the midpoint of the bore has a smaller diameter than the opposed axial ends.

16. An elevator system according to claim 15 wherein the variation in diameter between the midpoint and the opposed ends corresponds to a constant radius of curvature.

17. An elevator system according to claim 15 wherein the variation in diameter between the midpoint and the opposed ends corresponds to a varying radius of curvature.

18. An elevator system according to claim 1 wherein each distal portion further defines a transverse bore disposed in substantially perpendicular relation to the aperture axis, the transverse bores being configured to correspond upon engagement of the distal portions.

19. An elevator system according to claim 18 further comprising a fastener extending between the transverse bores and being configured to secure the engaged distal portions together.

20. An elevator system according to claim 1 wherein the flexible shock-absorbing substance comprises at least one of thermoplastic rubber and polyurethane.

21. An elevator system according to claim 1 wherein the medial portion of the cable-receiving structure is comprised of a flexible shock-absorbing substance.

22. A sway reduction device adapted to operably engage a wall having an elevator compensating cable at least partially disposed in spaced and substantially parallel relation thereto, the sway reduction device comprising:

a cable-receiving structure having opposed engagable distal portions and a flexible medial portion, the medial portion being configured to define an aperture upon engagement of the distal portions such that the aperture defines an axis, the cable-receiving structure being configured to receive the elevator compensating cable within the aperture through the distal portions such that the elevator compensating cable is capable of passing freely through the aperture in the axial direction, at least the distal portions being comprised of a flexible shock-absorbing substance so as to be capable of at least partially dissipating an impact energy resulting from contact of the elevator compensating cable with the cable-receiving structure, the distal portions further being configured to correspondingly engage so as to extend transversely in substantially perpendicular relation to the aperture axis; and a mounting member extending from each distal portion so as to be disposed perpendicularly to the aperture axis, the mounting members being configured to extend in substantially the same direction upon engagement of the distal portions and being adapted to engage the wall so as to secure the cable-receiving structure thereto.

23. A sway reduction device according to claim 22 wherein the cable-receiving structure is comprised of a moldable material.

24. A sway reduction device according to claim 23 wherein the moldable material further comprises at least one of a flame retardant additive and an inert filler.

25. A sway reduction device according to claim 23 wherein the moldable material is configured to be at least partially foamed.

26. A sway reduction device according to claim 23 wherein the moldable material comprises a non-compatible additive configured to migrate toward a surface of the cable-receiving structure.

27. A sway reduction device according to claim 22 further comprising a friction guard configured to operably engage and extend along the medial portion of the cable-receiving structure and to extend inwardly from the medial portion toward the aperture axis.

28. A sway reduction device according to claim 27 wherein the friction guard further comprises a medial guard portion and opposed engagable ends, the medial guard portion being configured to define a guard aperture upon engagement of the ends, the guard aperture being coaxial with the aperture axis, the friction guard being configured to receive the elevator compensating cable within the guard aperture through the ends and such that the elevator compensating cable is capable of passing freely through the guard aperture in the axial direction.

29. A sway reduction device according to claim 27 wherein the friction guard is configured to removably engage the cable-receiving structure.

30. A sway reduction device according to claim 27 wherein the friction guard comprises at least one of a metallic portion and a non-metallic portion.

31. A sway reduction device according to claim 22 wherein the friction guard is comprised of a material configured to be at least partially foamed.

32. A sway reduction device according to claim 27 wherein the friction guard comprises a low friction material.

33. A sway reduction device according to claim 27 wherein the friction guard comprises at least one of nylon, tetrafluoroethylene, silicone, and a polished metal.

34. A sway reduction device according to claim 22 wherein the medial portion of the cable-receiving structure defining the aperture is further configured to extend in the axial direction so as to define a bore having opposed axial ends and a midpoint.

35. A sway reduction device according to claim 34 wherein the midpoint of the bore has the same diameter as the opposed axial ends such that the bore comprises a cylinder.

36. A sway reduction device according to claim 34 wherein the midpoint of the bore has a smaller diameter than the opposed axial ends.

37. A sway reduction device according to claim 36 wherein the variation in diameter between the midpoint and the opposed ends corresponds to a constant radius of curvature.

38. A sway reduction device according to claim 36 wherein the variation in diameter between the midpoint and the opposed ends corresponds to a varying radius of curvature.

39. A sway reduction device according to claim 22 wherein each distal portion further defines a transverse bore disposed in substantially perpendicular relation to the aperture axis, the transverse bores being configured to correspond upon engagement of the distal portions.

40. A sway reduction device according to claim 39 further comprising a fastener extending between the transverse bores and being configured to secure the engaged distal portions together.

41. A sway reduction device according to claim 22 wherein the flexible shock-absorbing substance comprises at least one of thermoplastic rubber and polyurethane.

42. A sway reduction device according to claim 22 wherein the medial portion of the cable-receiving structure is comprised of a flexible shock-absorbing substance.

* * * * *

UNITED STATES PATENT AND TRADEMARK OFFICE

CERTIFICATE OF CORRECTION

PATENT NO. : 6,234,277 B1
DATED : May 22, 2001
INVENTOR(S) : Kaczmarek

It is certified that error appears in the above-identified patent and that said Letters Patent is hereby corrected as shown below:

Column 4,
Line 62, "stricture" should read -- structure --.

Column 7,
Line 13, "claim 22" should read -- claim 27 --.

Signed and Sealed this

Fifth Day of February, 2002

*Attest:*

*Attesting Officer*

JAMES E. ROGAN
*Director of the United States Patent and Trademark Office*